US007235121B2

(12) United States Patent
West

(10) Patent No.: US 7,235,121 B2
(45) Date of Patent: Jun. 26, 2007

(54) EXTERNALLY REMOVABLE VACUUM CLEANER FILTER APPARATUS

(76) Inventor: Timothy J. West, 281 Elm Ave., Delmar, NY (US) 12054

( * ) Notice: Subject to any disclaimer, the term of this patent is extended or adjusted under 35 U.S.C. 154(b) by 505 days.

(21) Appl. No.: 10/746,971

(22) Filed: Dec. 26, 2003

(65) Prior Publication Data

US 2005/0138762 A1 Jun. 30, 2005

(51) Int. Cl.
*B01D 46/00* (2006.01)

(52) U.S. Cl. ..... 95/273; 55/478; 55/480; 55/529; 55/357; 55/DIG. 3; 15/347

(58) Field of Classification Search ..... 55/DIG. 3, 55/301, 304, 359, 356, 421, 429, 493, 495, 55/502, 504, 478, 480, 481; 15/347, 327.1, 15/327.2, 327.6, 320; 210/767, 791; 95/278
See application file for complete search history.

(56) References Cited

U.S. PATENT DOCUMENTS

| | | | | |
|---|---|---|---|---|
| 739,263 | A | 9/1903 | Kenney | |
| 3,200,568 | A | 8/1965 | McNeil | |
| 4,010,015 | A | 3/1977 | Brown | |
| 4,183,116 | A * | 1/1980 | Thompson | 15/353 |
| 4,268,288 | A | 5/1981 | Coombs | |
| 4,389,931 | A | 6/1983 | Sutter | |
| 4,426,211 | A * | 1/1984 | Ataka et al. | 55/296 |
| 4,581,050 | A | 4/1986 | Krantz | |
| 4,906,265 | A | 3/1990 | Berfield | |
| 5,067,394 | A | 11/1991 | Cavallero | |
| 5,080,697 | A | 1/1992 | Finke | |
| 5,160,356 | A | 11/1992 | Dyson | |
| 5,254,147 | A | 10/1993 | Finke | |
| 5,267,371 | A | 12/1993 | Soler et al. | |
| 5,307,538 | A | 5/1994 | Rench et al. | |
| 5,608,945 | A | 3/1997 | Crouser et al. | |
| 5,664,285 | A | 9/1997 | Melito et al. | |
| 5,783,086 | A | 7/1998 | Scanlon et al. | |
| 5,943,730 | A * | 8/1999 | Boomgaarden | 15/320 |
| 5,968,231 | A | 10/1999 | Parmentier et al. | |
| 6,009,596 | A * | 1/2000 | Buss et al. | 15/353 |
| 6,083,292 | A | 7/2000 | Fumagalli | |
| 6,113,663 | A | 9/2000 | Liu | |
| 6,235,195 | B1 * | 5/2001 | Tokar | 210/238 |
| 6,309,469 | B2 | 10/2001 | Storrs et al. | |
| 6,312,594 | B1 | 11/2001 | Conrad et al. | |
| 6,440,191 | B1 | 8/2002 | Berfield et al. | |
| 6,471,751 | B1 | 10/2002 | Semanderes et al. | |
| 6,485,536 | B1 | 11/2002 | Masters | |
| 6,547,856 | B2 | 4/2003 | Cartellone | |
| 6,591,446 | B2 | 7/2003 | Bair et al. | |
| 6,775,882 | B2 * | 8/2004 | Murphy et al. | 15/352 |
| 7,086,119 | B2 * | 8/2006 | Go et al. | 15/353 |

(Continued)

*Primary Examiner*—Duane Smith
*Assistant Examiner*—Robert Clemente
(74) *Attorney, Agent, or Firm*—Schmeiser, Olsen & Watts

(57) ABSTRACT

A method and structure for externally removing a filter apparatus from a vacuum cleaner. The vacuum cleaner comprises a vessel, a lid removably attached to the vessel, a port, a suction apparatus adapted to create a vacuum within the vessel and draw a substance through the port into the vessel, and a filter apparatus positioned between the port and the suction apparatus. The filter apparatus comprises a frame and a filter. The filter is adapted to remove a plurality of particles from the substance. The filter apparatus is adapted to be removed from the vacuum cleaner without removing the lid.

40 Claims, 4 Drawing Sheets

U.S. PATENT DOCUMENTS

2003/0167590 A1* 9/2003 Oh ..... 15/347
2004/0163368 A1* 8/2004 Lee et al. ..... 55/429
2004/0200030 A1* 10/2004 Baer ..... 15/353
2006/0123588 A1* 6/2006 Kaiser ..... 15/352

* cited by examiner

EXTERNALLY REMOVABLE VACUUM CLEANER FILTER APPARATUS

BACKGROUND OF THE INVENTION

1. Technical Field

The present invention relates to an apparatus and associated method to externally remove a filter from a vacuum cleaner.

2. Related Art

Removing structures from appliances for cleaning or replacement typically requires a complete disassembly of the appliance. Disassembling an appliance may be difficult and very time consuming. Therefore there is a need for an appliance that does not require disassembling to remove structures for cleaning or replacement.

SUMMARY OF THE INVENTION

The present invention provides a vacuum cleaner, comprising:

a vessel;

a lid removably attached to the vessel;

a port;

a suction apparatus adapted to create a vacuum within the vessel and draw a substance through the port into the vessel; and a filter apparatus positioned between the port and the suction apparatus, wherein the filter apparatus comprises a frame and a filter, wherein the filter is adapted to remove a plurality of particles from the substance, and wherein the filter apparatus is adapted to be removed from the vacuum cleaner without removing the lid.

The present invention provides a filter apparatus, comprising:

a frame; and a filter positioned within the frame, wherein the filter is adapted to remove a plurality of particles from a substance being drawn into a vacuum cleaner, and wherein the filter apparatus is adapted to be removed from the vacuum cleaner through an opening within the vacuum cleaner without disassembling the vacuum cleaner.

The present invention provides a method, comprising:

providing a vacuum cleaner comprising: a vessel, a lid removably attached to the vessel, a port, a suction apparatus adapted to create a vacuum within the vessel and draw a substance through the port into the vessel, and a filter apparatus comprising a frame and a filter;

positioning the filter apparatus between the port and the suction apparatus;

removing by the filter a plurality of particles from the substance; and removing the filter apparatus from the vacuum cleaner without removing the lid.

The present invention advantageously provides a structure and associated method to provide an appliance that does not require disassembling to remove structures for cleaning or replacement.

DETAILED DESCRIPTION OF THE INVENTION

Figure 1:
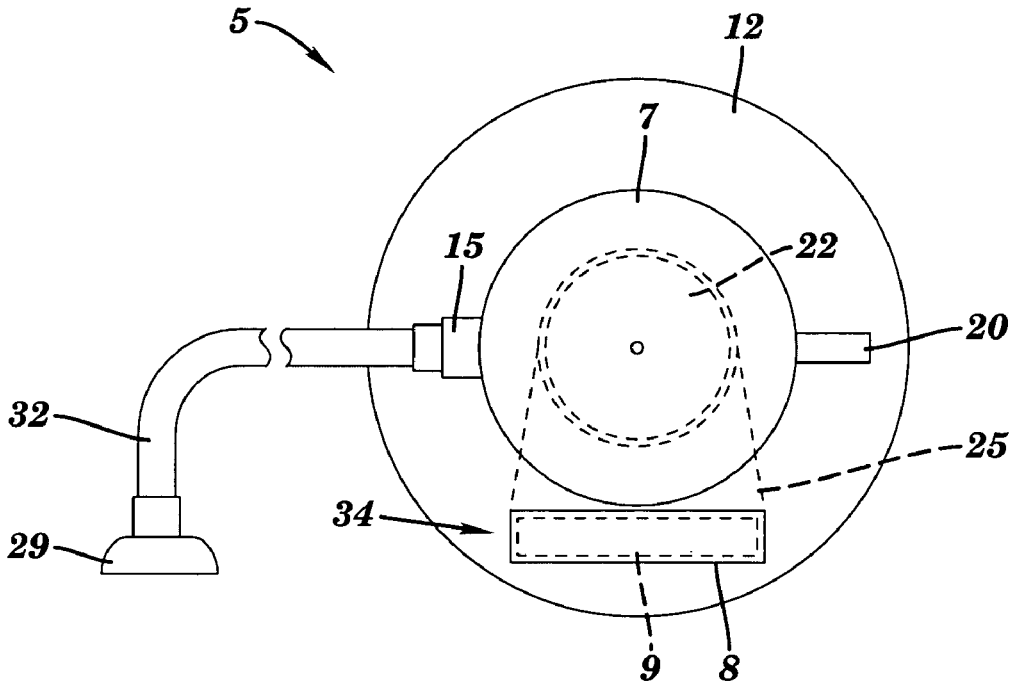
FIG. 1 illustrates a top view of a of a vacuum cleaner comprising a filter apparatus in accordance with embodiments of the present invention.

FIG. 1 illustrates a top view of a of a vacuum cleaner 5 comprising an externally removable filter apparatus 9, in accordance with embodiments of the present invention. The vacuum cleaner 5 may be, inter alia, a wet/dry utility vacuum cleaner. A wet/dry utility vacuum cleaner is defined herein including in the claims as a heavy duty vacuum cleaner that may be used to retrieve either a liquid substance (e.g., water) that may comprise particles (e.g., sawdust, dirt, dust, plaster, etc.), a gaseous substance (e.g., air) that may comprise particles (e.g., sawdust, dirt, dust, plaster, etc.), or a combination of a gaseous and a liquid substance comprising particles (e.g., sawdust, dirt, dust, plaster, etc). The wet/dry utility vacuum cleaner may be bagless (i.e., without a vacuum cleaner bag to hold particles). Alternatively, the wet/dry utility vacuum cleaner may comprise a vacuum cleaner bag to hold particles. The vacuum cleaner 5 may be used for, inter alia, industrial applications, residential applications, etc. The vacuum 5 may be a cyclonic air flow vacuum. In addition to the filter apparatus 9, the vacuum cleaner 5 comprises a vessel 28 (see FIG. 2), a lid 12 removably attached to the vessel 28, an input port 15, an output port 20, a filter cover assembly 8, an adapter assembly 25, and a suction apparatus 7 comprising a motor 22. The wet/dry utility vacuum cleaner (i.e., vacuum cleaner 5) may be adapted to retrieve and hold a large amount (e.g., greater than or equal to about 1 gallon) of a liquid substance (e.g., water) in the vessel 28. Alternatively, the wet/dry utility vacuum cleaner may (i.e., vacuum cleaner 5) may be adapted to retrieve and hold a small amount (e.g., less than about 1 gallon) of a liquid substance (e.g., water) in the vessel 28. The vessel 28 may be, inter alia, a tank, a bucket, etc. The vessel 28 may comprise, inter alia, metal, plastic, etc. The motor may be any motor known to a person of ordinary skill in the art including, inter alia, an electrical motor, a gas motor, etc. The lid 12 is mechanically attached to the suction apparatus 7 comprising the motor 22. The filter assembly 9 is placed between the suction apparatus 7 and the input port 15. Note that although the filter assembly 9 shown in FIG. 1 is placed about 90° from the input port 15, the filter assembly 9 may be placed at any angular position within about 360° from the input port 15. A hose 32 may be removably attached to the input port 15. A nozzle 29 may be removably attached to the hose 32. An impeller 84 (as shown in FIG. 4) may be mechanically attached to the motor 22 such that when the motor is activated (i.e., the vacuum cleaner 5 is in operation) a low pressure area (i.e., a vacuum) is created within the vessel 28. A pressure difference between the low pressure area in the vessel 28 and the nozzle 29 causes a suction (i.e., vacuum) effect at the nozzle 29. A gaseous and/or liquid substance enters the nozzle 29 and travels through the hose 32. Any liquid substance is deposited in the vessel. The gaseous and/or liquid substance may comprise a plurality of particles (e.g., dirt, dust, plaster, sawdust, etc.). At least some of the plurality particles will become trapped in the filter element 19 (see FIG. 2 and described in detail in the description of FIG. 2) of the filter assembly 9 since the suction is created by the suction apparatus 7 and the filter apparatus 9 comprising the filter element 19 is placed between the suction apparatus 7 and the input port 15 mechanically attached to the hose 32. Any gaseous substance passing through the filter apparatus 9 is exhausted through the output port 20. Eventually, the filter element 19 (see FIG. 2) will become clogged with particles (e.g., dirt, dust, plaster, sawdust, etc.) and require cleaning and/or replacement. The externally removable filter apparatus 9 may be removed so that the filter element 19 may be cleaned or the entire filter apparatus 9 may be replaced. The externally removable filter apparatus 9 may be removed externally without having to disassemble (e.g., removing the lid 12 mechanically attached to the suction apparatus 7) the vacuum cleaner 5. To remove the filter apparatus 9, the filter cover assembly 8 is displaced (i.e., positioned) away from an opening 34 in the lid 12. The opening 34 is located above the location of the filter apparatus 9. After the filter cover assembly 8 is displaced a user may retrieve the filter apparatus 9 for cleaning and/or replacement through the opening 34. The clean or new filter apparatus 9 may be placed back into the vacuum cleaner 5 through the opening 34 and the lid 12 is placed such that the opening 34 is sealingly covered. To access the filter apparatus 9, the filter cover assembly 8 may be completely removed from the lid 12. As a first alternative, the filter cover assembly 8 may be pivotally attached (e.g., using a hinge) to the lid 12 and the filter cover assembly 8 may be positioned away from the opening 34 at a plurality of angular positions with respect to the lid 12 (see FIG. 5). A spring may be used to reposition the filter cover assembly 8 back over the opening. As a second alternative, the filter cover assembly 8 may be mechanically attached to the filter apparatus 9 so that the filter cover assembly 8 and the filter apparatus 9 may be removed from the vacuum cleaner 5 as one piece. The filter cover assembly 8 mechanically attached to the filter apparatus 9 may be a disposable item. Additionally, the filter cover assembly 8 may be removably attached to the filter apparatus 9. A filter holder 25 (shown in detail in FIG. 3) may be mechanically attached to the suction apparatus 7 and/or the a lid 12. The filter holder 25 may additionally surround the suction apparatus 7 (i.e., so that the suction apparatus 7 is within the filter holder 25). The filter holder 25 functions as a holder for the filter apparatus 9 (i.e., to keep the filter apparatus 9 placed between the suction apparatus 7 and the input port 15). The filter holder 25 may be permanently mechanically attached to the suction apparatus 7 and/or the lid. Alternatively, the filter holder 25 may be removably attached to the suction apparatus 7 and/or the lid 12 thereby enabling the filter holder 25 to be retrofitted for a plurality of different vacuum cleaners (i.e., different designs, different manufacturers, etc).

Figure 2:
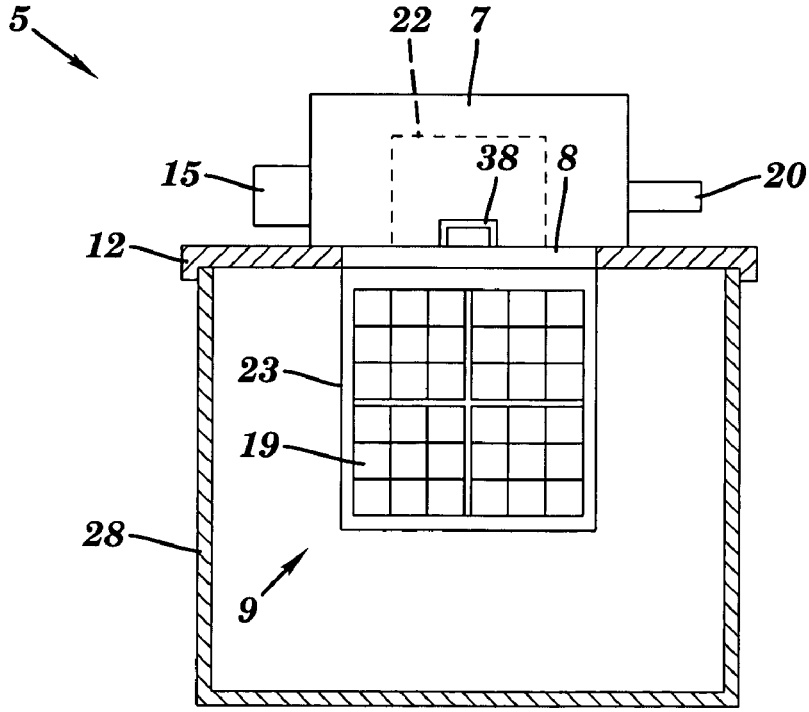
FIG. 2 illustrates a cross sectional side view of FIG. 1 showing the vacuum cleaner comprising the filter apparatus, in accordance with embodiments of the present invention.

FIG. 2 illustrates a cross sectional side view of FIG. 1 showing the vacuum cleaner 5 comprising the externally removable filter apparatus 9, in accordance with embodiments of the present invention. The vacuum cleaner 5 comprises the vessel 28 and the lid 12 removably attached to the vessel 28 as described in the description of FIG. 1. The filter apparatus 9 comprises a filter element 19 and a frame 23. The frame 23 is adapted to keep the filter element 19 rigid. The filter element 19 is adapted to trap a plurality of particles (e.g., dirt, dust, plaster, sawdust, etc.) retrieved by the vacuum cleaner 5 as described in the description of FIG. 1. The filter element 9 may comprise any filter material known to a person of ordinary skill in the art including, inter alia, paper, cloth, foam, metal, etc. The filter element 9 may be adapted for use with a liquid substance (e.g., water) that may comprise particles (e.g., sawdust, dirt, dust, plaster, etc.), a gaseous substance (e.g., air) that may comprise particles (e.g., sawdust, dirt, dust, plaster, etc.), or a combination of a gaseous and a liquid substance comprising particles (e.g., sawdust, dirt, dust, plaster, etc). The filter element 19 may be cleanable (i.e., reusable). Alternatively, the filter apparatus 9 may be disposable. The filter cover assembly 8 may comprise a handle 38.

Figure 3:
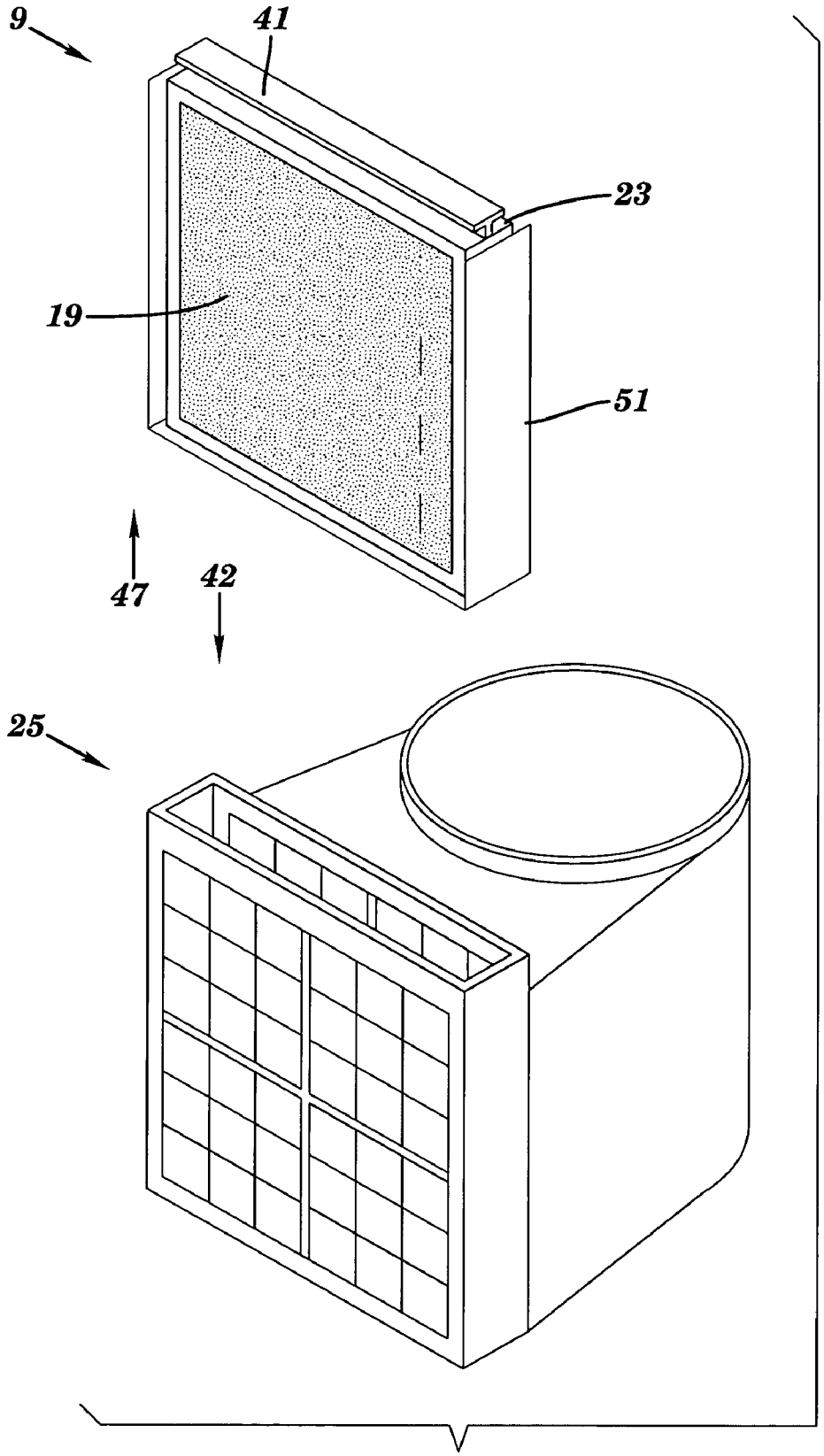
FIG. 3 illustrates a three dimensional view of the filter holder and the filter apparatus of FIG. 1, in accordance with embodiments of the present invention.
Figure 4:
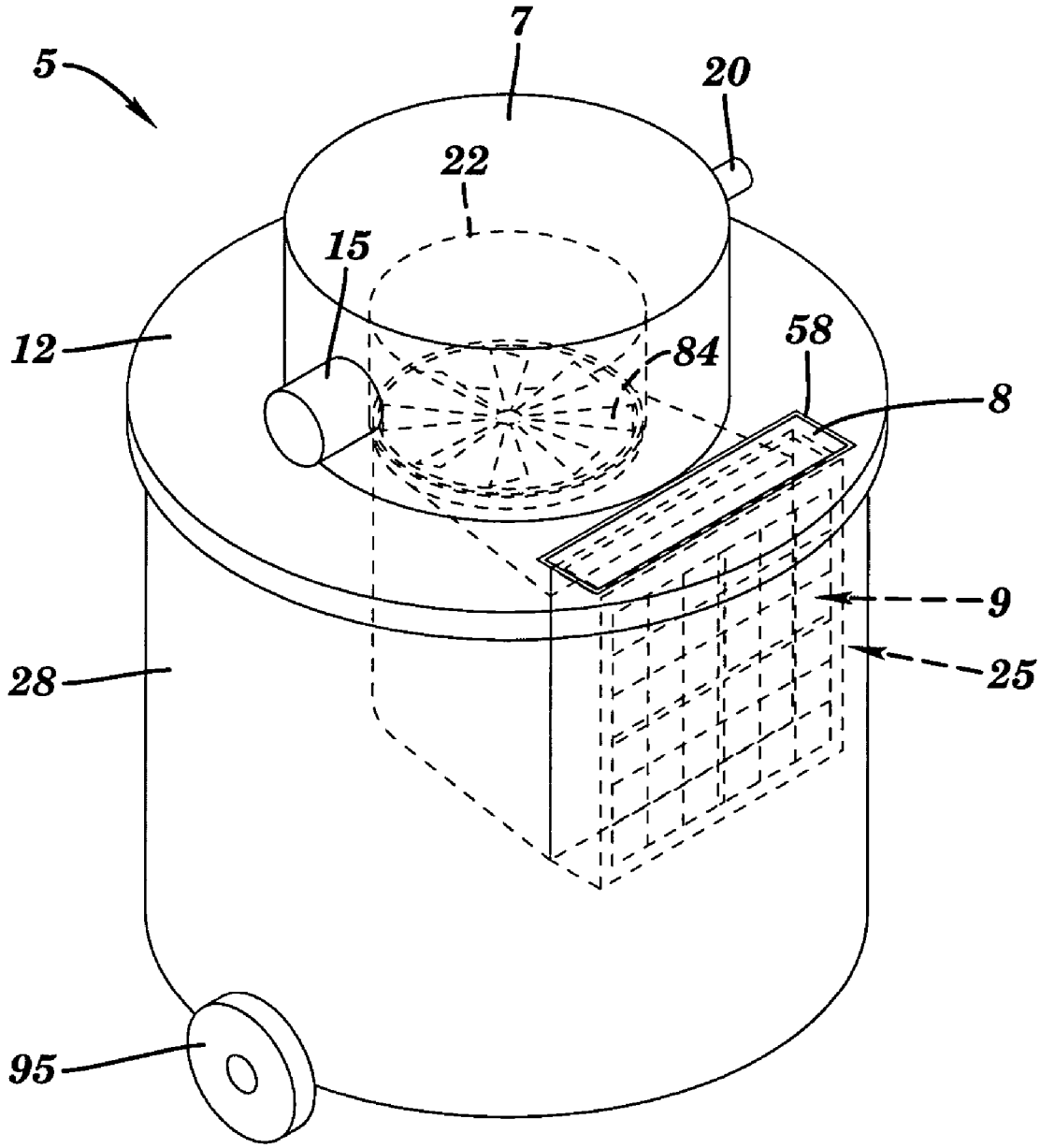
FIG. 4 illustrates a three dimensional view of the vacuum cleaner of FIG. 1, in accordance with embodiments of the present invention.

FIG. 3 illustrates a three dimensional view of the filter holder 25 and the filter apparatus 9 of FIG. 1, in accordance with embodiments of the present invention. The filter holder 25 may be mechanically attached to the suction apparatus 7 and/or the lid 12 of FIG. 1. The filter holder 25 may additionally surround the suction apparatus 7 (i.e., so that the suction apparatus 7 is within the filter holder 25). The filter holder 25 functions as a holder for the filter apparatus 9 (i.e., to keep the filter apparatus 9 placed between the suction apparatus 7 and the input port 15 of FIG. 1). The filter holder 25 may be permanently mechanically attached to the suction apparatus 7 and/or the lid 12 of FIG. 1. Alternatively, the filter holder 25 may be removably attached to the suction apparatus 7 and/or the a lid 12 of FIG. 1 thereby enabling the filter holder 25 to be retrofitted for a plurality of different vacuum cleaners (i.e., different designs, different manufacturers, etc). The filter apparatus 9 is adapted to be slidedly placed within the filter holder 25 in a direction 42. The filter apparatus 9 is adapted to be slidedly removed from the filter holder 25 in a direction 47. A handle 41 may be attached to the filter apparatus 9 for placing or retrieving filter apparatus 9. A seal 51 (e.g., a gasket) may be placed around the perimeter of the filter apparatus 9 (i.e., around the frame 23). The seal 51 functions as a barrier to keep the filter apparatus 9 airtight within the filter holder 25. The seal 51 may comprise any gasket material known to a person of ordinary skill in the art including, inter alia, rubber, felt, cork, etc. Note that although the filter apparatus 9 shown in FIG. 3 comprises a square shape, the filter apparatus 9 may alternatively comprise any shape including, inter alia, rectangular, triangular, round, cylindrical, trapezoidal, etc.

Figure 5:
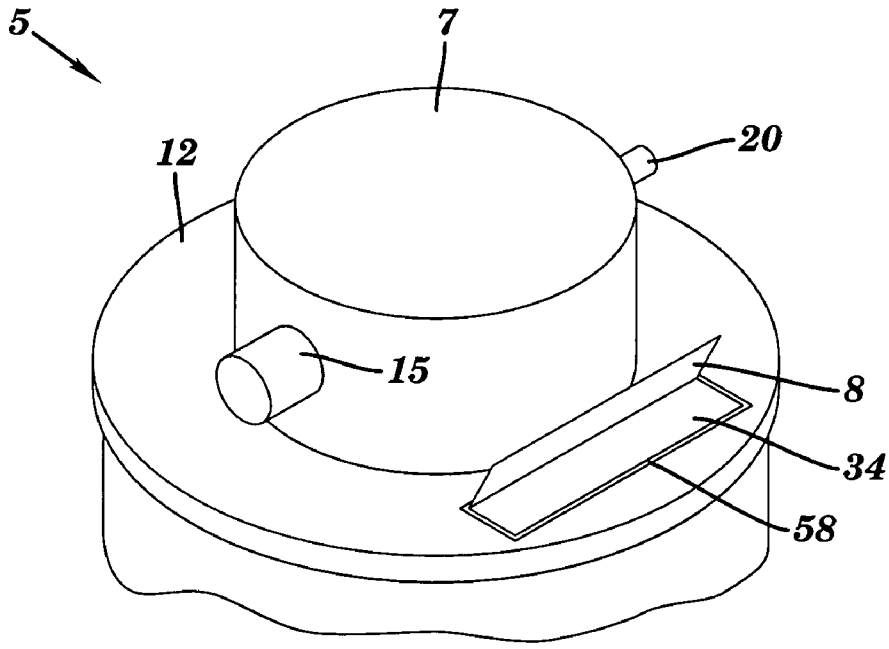
FIG. 5 illustrates FIG. 1 comprising a pivotally attached filter cover, in accordance with embodiments of the present invention.

FIG. 4 illustrates a three dimensional view of the vacuum cleaner 5 of FIG. 1 comprising the filter apparatus 9, in accordance with embodiments of the present invention. As described in the description of FIG. 1, the vacuum cleaner 5 may be, inter alia, a wet/dry utility vacuum cleaner. The impeller 84 mechanically attached to the motor 22 causes a suction (i.e., vacuum) effect at the input port 15. Note that to remove the filter apparatus 9, the filter cover assembly 8 may be displaced (i.e., positioned) away from the opening 34 in the lid 12 and the filter apparatus 9 may be retrieved through the opening. Note that the fully removable filter cover assembly 8 shown in FIG. 4 is shown for illustration purposes and that the filter cover assembly 8 may alternatively be pivotally attached (e.g., using a hinge) to the lid 12 and the filter cover assembly 8 may be positioned away from the opening 34 at a plurality of angular positions with respect to the lid 12 as shown in FIG. 5. Additionally, the filter cover assembly 8 may be mechanically attached to the filter apparatus 9 (shown in FIG. 6) so that the filter cover assembly 8 and the filter apparatus 9 may be removed from the vacuum cleaner 5 as one piece. The filter cover assembly 8 mechanically attached to the filter apparatus 9 may be a disposable item. Additionally, the filter cover assembly 8 may be removably attached to the filter apparatus 9. In all of the aforementioned embodiments, the filter cover assembly 8 may comprise a seal 58 (e.g., a gasket) that is placed around the perimeter of the filter cover assembly 8. The seal 58 functions as a barrier to keep the filter cover assembly 8 sealed to the lid 12 so that the vacuum cleaner 5 is airtight. The seal 58 may comprise any gasket material known to a person of ordinary skill in the art including, inter alia, rubber, felt, cork, etc. The opening 34 is located above the location of the filter apparatus 9. The vacuum cleaner 5 may comprises a wheel(s) 95 so that the vacuum cleaner 5 may be moved along a surface (e.g., a floor, the ground, etc.) in a plurality of directions.

FIG. 5 illustrates a variation of FIG. 1 showing a top view of the vacuum cleaner comprising the externally removable filter apparatus 9, in accordance with embodiments of the present invention. The filter cover assembly 8 in FIG. 5 is pivotally attached (e.g., using a hinge) to the lid 12 so that the filter cover assembly 8 may be positioned away from the opening 34 at a plurality of angular positions with respect to the lid 12. A spring may be used to reposition the filter cover assembly 8 back over the opening 34.

Figure 6:
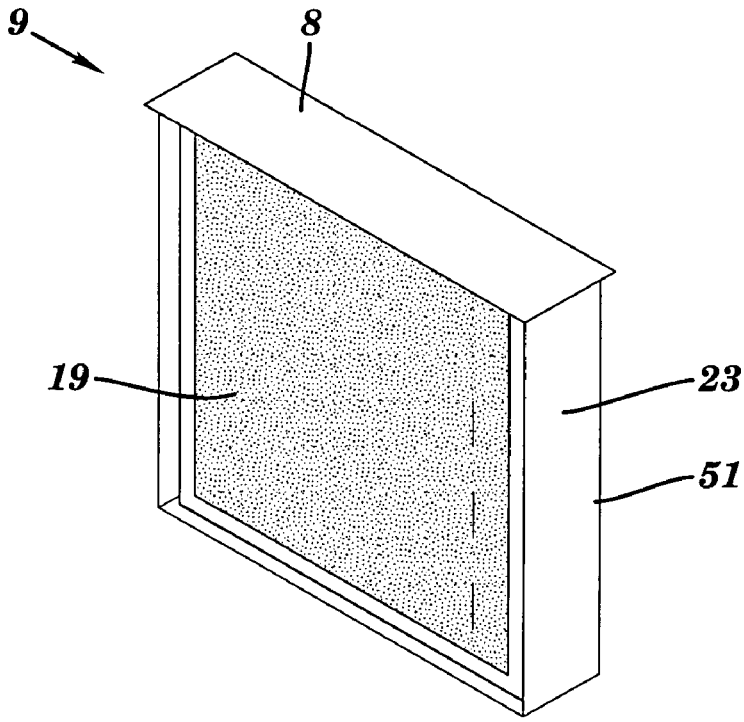
FIG. 6 illustrates a three dimensional view of the filter apparatus of FIG. 4 comprising the filter cover assembly, in accordance with embodiments of the present invention

FIG. 6 illustrates a three dimensional view of the filter apparatus 9 of FIG. 4 comprising the filter cover assembly 8, in accordance with embodiments of the present invention. The filter cover assembly 8 is mechanically attached to the filter apparatus 9 so that the filter cover assembly 8 and the filter apparatus 9 may be removed from the vacuum cleaner 5 as one piece. The filter cover assembly 8 mechanically attached to the filter apparatus 9 may be a disposable item. Additionally, the filter cover assembly 8 may be removably attached to the filter apparatus 9.

While embodiments of the present invention have been described herein for purposes of illustration, many modifications and changes will become apparent to those skilled in the art. Accordingly, the appended claims are intended to encompass all such modifications and changes as fall within the true spirit and scope of this invention.

What is claimed is:

1. A method, comprising:

providing a vacuum cleaner comprising: a vessel, a lid removably attached to the vessel, a port, a suction apparatus adapted to create a vacuum within the vessel and draw a substance through the port into the vessel, a filter apparatus comprising a frame and a filter, and a filter cover assembly pivotally attached to said lid, wherein the lid comprises an opening, wherein the filter cover assembly is adapted to cover the opening, wherein the filter cover assembly is adapted to be positioned at a plurality of angular positions with respect to the lid, and wherein the filter cover assembly comprises a spring adapted to position the filter cover assembly over the opening;

positioning the filter apparatus between the port and the suction apparatus;

removing by the filter a plurality of particles from the substance;

removing the filter apparatus from the vacuum cleaner without removing the lid by positioning the filter cover assembly at a first angular position with respect to the lid and retrieving the filter apparatus through the opening; and positioning, by the spring, the filter cover assembly over the opening.

2. The method of claim 1, wherein the vacuum cleaner is a wet/dry utility vacuum cleaner, and wherein the substance may be selected from the group consisting of a liquid substance, a gaseous substance, and a combination thereof.

3. The method of claim 2, wherein the substance includes the liquid substance.

4. The method of claim 2, wherein the substance includes the gaseous substance.

5. The method of claim 1, further comprising:

providing a handle attached to the filter apparatus; and using the handle to remove the filter apparatus from the opening.

6. The method of claim 1, wherein the filter apparatus is disposable.

7. The method of claim 1, wherein the filter apparatus is cleanable.

8. The method of claim 1, wherein the filter comprises a material selected from the group consisting of paper, cloth, metal, and foam.

9. The method of claim 1, wherein the suction apparatus comprises an electrical motor.

10. The method of claim 1, further comprising positioning the filter apparatus no more than 180° from the port.

11. The method of claim 1, wherein the filter apparatus comprises a shape selected from the group consisting of a square shape, a rectangular shape, a triangular shape, a round shape, a trapezoidal shape, and a cylindrical shape.

12. The method of claim 1, further comprising a filter holder attached to the suction apparatus, wherein the filter apparatus is placed within the filter holder.

13. The method of claim 1, further comprising a filter holder attached to the lid, wherein the filter apparatus is placed within the filter holder.

14. The method of claim 1, wherein the suction apparatus comprises a gas motor.

15. A vacuum cleaner, comprising:

a vessel;

a lid removably attached to the vessel;

a port;

a suction apparatus adapted to create a vacuum within the vessel and draw a substance through the port into the vessel;

a filter apparatus positioned between the port and the suction apparatus, wherein the filter apparatus comprises a frame and a filter, wherein the filter is adapted to remove a plurality of particles from the substance, and wherein the filter apparatus is adapted to be removed from the vacuum cleaner without removing the lid; and a filter cover assembly, wherein the lid comprises an opening, wherein the filter cover assembly is adapted to cover the opening, wherein the filter cover assembly is pivotally attached to the lid, wherein the filter cover assembly is adapted to be positioned at a plurality of angular positions with respect to the lid, wherein the filter cover assembly comprises a spring adapted to position the filter cover assembly over the opening, and wherein the filter apparatus is adapted to be removed from the vacuum cleaner through the opening.

16. The vacuum cleaner of claim 15, wherein the vacuum cleaner is a wet/dry utility vacuum cleaner, and wherein the substance may be selected from the group consisting of a liquid substance, a gaseous substance, and a combination thereof.

17. The vacuum cleaner of claim 16, wherein the substance includes the liquid substance.

18. The vacuum cleaner of claim 16, wherein the substance includes the gaseous substance.

19. The vacuum cleaner of claim 15, wherein the filter apparatus further comprises a handle for removing the filter apparatus.

20. The vacuum cleaner of claim 15, wherein the filter apparatus is disposable.

21. The vacuum cleaner of claim 15, wherein the filter apparatus is cleanable.

22. The vacuum cleaner of claim 15, wherein the filter comprises a material selected from the group consisting of paper, cloth, metal, and foam.

23. The vacuum cleaner of claim 15, wherein the suction apparatus is attached to the lid, and wherein the suction apparatus comprises an electrical motor.

24. The vacuum cleaner of claim 15, wherein the filter apparatus is adapted to be positioned no more than 180° from the port.

25. The vacuum cleaner of claim 15, wherein the filter apparatus comprises a shape selected from the group consisting of a square shape, a rectangular shape, a triangular shape, a round shape, a trapezoidal shape, and a cylindrical shape.

26. The vacuum cleaner of claim 15, further comprising a filter holder attached to the suction apparatus, wherein the filter apparatus is placed within the filter holder.

27. The vacuum cleaner of claim 15, further comprising a filter holder attached to the lid, wherein the filter apparatus is placed within the filter holder.

28. The vacuum cleaner of claim 15, wherein the suction apparatus comprises a gas motor.

29. A vacuum cleaner, comprising:

a vessel;

a lid removably attached to the vessel;

a port;

a suction apparatus adapted to create a vacuum within the vessel and draw a substance through the port into the vessel;

a filter apparatus positioned between the port and the suction apparatus, wherein the filter apparatus comprises a frame and a filter, wherein the filter is adapted to remove a plurality of particles from the substance, wherein the filter apparatus is adapted to be removed from the vacuum cleaner without removing the lid, wherein the lid comprises an opening, wherein the filter apparatus further comprises a filter cover adapted to cover the opening, wherein the filter cover is permanently attached to the frame, and wherein filter apparatus is adapted to be removed from the vacuum cleaner by removing the filter cover.

30. The vacuum cleaner of claim 26, wherein the vacuum cleaner is a wet/dry utility vacuum cleaner, and wherein the substance may be selected from the group consisting of a liquid substance, a gaseous substance, and a combination thereof.

31. The vacuum cleaner of claim 26, wherein the filter apparatus further comprises a handle for removing the filter apparatus.

32. The vacuum cleaner of claim 26, wherein the filter apparatus is disposable.

33. The vacuum cleaner of claim 26, wherein the filter apparatus is cleanable.

34. The vacuum cleaner of claim 26, wherein the filter comprises a material selected from the group consisting of paper, cloth, metal, and foam.

35. The vacuum cleaner of claim 26, wherein the filter apparatus is adapted to be positioned no more than 180° from the port.

36. The vacuum cleaner of claim 26, wherein the filter apparatus comprises a shape selected from the group consisting of a square shape, a rectangular shape, a triangular shape, a round shape, a trapezoidal shape, and a cylindrical shape.

37. The vacuum cleaner of claim 26, further comprising a filter holder attached to the suction apparatus, wherein the filter apparatus is placed within the filter holder.

38. The vacuum cleaner of claim 26, further comprising a filter holder attached to the lid, wherein the filter apparatus is placed within the filter holder.

39. The vacuum cleaner of claim 26, wherein the suction apparatus comprises an electrical motor.

40. The vacuum cleaner of claim 26, wherein the suction apparatus comprises a gas motor.

* * * * *

UNITED STATES PATENT AND TRADEMARK OFFICE

CERTIFICATE OF CORRECTION

PATENT NO. : 7,235,121 B2
APPLICATION NO. : 10/746971
DATED : June 26, 2007
INVENTOR(S) : West It is certified that error appears in the above-identified patent and that said Letters Patent is hereby corrected as shown below:

Column 1
Line 62, delete "of a"

Column 2
Line 12, delete "invention" and insert -- invention. --
Line 17, delete "of a"

Column 4
Line 27, delete "a"

Column 5
Line 11, delete " comprises" and insert -- comprise --

Signed and Sealed this

Seventh Day of August, 2007

JON W. DUDAS
*Director of the United States Patent and Trademark Office*